US011969101B2

(12) United States Patent
Oswald

(10) Patent No.: US 11,969,101 B2
(45) Date of Patent: Apr. 30, 2024

(54) LAYERED SLEEP SYSTEM

(71) Applicant: ACTIVE AND INNOVATIVE INC., Toronto (CA)

(72) Inventor: Christopher Allan Oswald, Toronto (CA)

( * ) Notice: Subject to any disclaimer, the term of this patent is extended or adjusted under 35 U.S.C. 154(b) by 0 days.

(21) Appl. No.: 17/274,843

(22) PCT Filed: Sep. 13, 2019

(86) PCT No.: PCT/CA2019/051299

§ 371 (c)(1),
(2) Date: Mar. 10, 2021

(87) PCT Pub. No.: WO2020/056495

PCT Pub. Date: Mar. 26, 2020

(65) Prior Publication Data

US 2021/0244197 A1 Aug. 12, 2021

Related U.S. Application Data

(60) Provisional application No. 62/732,022, filed on Sep. 17, 2018.

(51) Int. Cl.

| | |
|---|---|
| ***A47C 27/15*** | (2006.01) |
| ***A47C 27/14*** | (2006.01) |
| ***A47C 31/12*** | (2006.01) |

(52) U.S. Cl.

CPC ..... *A47C 27/15* (2013.01); *A47C 27/148* (2013.01); *A47C 31/123* (2013.01)

(58) Field of Classification Search

CPC ..... A47C 27/15; A47C 31/123; A47C 27/144; A47C 27/001; A47C 27/062

See application file for complete search history.

(56) References Cited

U.S. PATENT DOCUMENTS 5,031,261 A * 7/1991 Fenner, Sr. ..... A47C 27/146 5/736
5,513,402 A * 5/1996 Schwartz ..... A47C 27/16 5/691

(Continued)

FOREIGN PATENT DOCUMENTS

JP H7-509376 A 10/1995
JP 2001-519186 A 10/2001

(Continued)

OTHER PUBLICATIONS

The average Americans' weight change since the 1980s is startling, WTSP, Aug. 3, 2016, https://www.wtsp.com/article/life/food/the-average-americans-weight-change-since-the-1980s-is-startling/67-286774762 (Year: 2016).*

(Continued)

*Primary Examiner* — Justin C Mikowski
*Assistant Examiner* — Amanda L Bailey
(74) *Attorney, Agent, or Firm* — Anglehart et al.

(57) ABSTRACT

The present disclosure provides a mattress comprising at least one zonal mattress element a midsection that is firmer than the upper and lower sections and configured to provide support for a hip of a user side sleeping on the mattress and at least one uniform mattress element which provides a neutral posture and may be rearranged to give different users different zonal variations. Furthermore, it discloses a system of the mattress with a pillow to provide a neutral posture or aligned spine to improve both side and back sleeping with neural posture resulting in better sleep, less snoring and less pain.

14 Claims, 11 Drawing Sheets

(56) References Cited

U.S. PATENT DOCUMENTS

| | | | | |
|---|---|---|---|---|
| 5,953,779 | A | 9/1999 | Schwartz | |
| 6,115,861 | A * | 9/2000 | Reeder | A61G 7/05776 5/690 |
| 2004/0237206 | A1* | 12/2004 | Webster | A47C 27/146 5/730 |
| 2005/0115003 | A1* | 6/2005 | Torbet | A47C 27/082 5/727 |
| 2014/0208517 | A1* | 7/2014 | Gross | A47C 27/15 5/691 |
| 2015/0208819 | A1* | 7/2015 | Mckay | A47C 27/148 5/423 |
| 2015/0305514 | A1 | 10/2015 | Kulju | |
| 2017/0224126 | A1* | 8/2017 | O'Connell, Jr. | A47G 9/10 |
| 2018/0279795 | A1* | 10/2018 | Murphy | A47C 27/15 |
| 2019/0274443 | A1* | 9/2019 | Chan | A47C 27/146 |
| 2019/0298078 | A1* | 10/2019 | Vester, III | A47C 27/148 |
| 2019/0333127 | A1* | 10/2019 | Nolte | A47C 31/105 |

FOREIGN PATENT DOCUMENTS

| | | | | |
|---|---|---|---|---|
| JP | 2009-183513 | A | 8/2009 | |
| JP | 2011-189109 | A | 9/2011 | |
| JP | 3184215 | U | 6/2013 | |
| KR | 20020024023 | A * | 3/2002 | A47C 27/148 |
| WO | 2012/028763 | A1 | 3/2012 | |
| WO | WO-2012028763 | A1 * | 3/2012 | A47C 27/001 |
| WO | 2012/094468 | A1 | 7/2012 | |

OTHER PUBLICATIONS

2018 Buyer' Guide to the Best Memory Foam Mattresses, Sleep Mogul, Mar. 3, 2018, https://www.sleepmogul.com/best-memory-foam-mattress-reviews/ (Year: 2018).*

International application No. PCT/CA2019/051299 international preliminary report on patentability dated Dec. 18, 2020.

International application No. PCT/CA2019/051299 International Search Report dated Nov. 20, 2019.

International application No. PCT/CA2019/051299 Written Opinion of the International Searching Authority dated Nov. 20, 2019.

International application No. PCT/CA2019/051299 Search Strategy dated Nov. 20, 2019.

Corresponding European application No. 19863001.4 extended European search report dated Apr. 25, 2022.

Corresponding Japanese application No. 2021-514613 examination report dated Jul. 25, 2023.

Corresponding Japanese application No. 2021-514613 examination report dated Jan. 23, 2024. (Google translation provided).

Corresponding European application No. 19863001.4 examination report dated Oct. 10, 2023.

* cited by examiner

LAYERED SLEEP SYSTEM

CROSS-REFERENCE TO RELATED APPLICATIONS

This application claims priority of U.S. provisional patent application Ser. No. 62/732,022 filed Sep. 17, 2018, the specification of which is incorporated by reference herein.

TECHNICAL FIELD

The present application generally relates to mattresses and more specifically to layered mattresses.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

In recent years there have been mattresses with a variety of options in terms of their hardness, or firmness which is generally determined by the choice of materials made during the construction of each of the mattress and the base. Furthermore, it is possible to have different firmness at different points within a particular bed.

Moreover, now its possible to have mattresses that give a user the choice to adjust the firmness even after the purchase which is very helpful in removing the limitation imposed on the consumer who generally, chose their mattress by sitting or lying on some options briefly. This method of shopping has resulted in consumer dissatisfaction of quality and so many of them being stuck with an expensive mattress that they cannot return either due to the complexity of the logistics involved in the return procedure or due to retailer's policies.

In U.S. Pat. No. 5,513,402 is an example of such sleeping system. Schwartz, describes a stack of individual mattress elements that includes a plurality of foam mattress elements, which provide a range of choices of firmness for users by adding a higher level of firmness, either over a partial area of the mattress by means of the torso board, or over substantially the whole area of the mattress by means of the rigid core element. If deemed desirable, both a torso board and a core element could be used together to deliver an extra firm mattress.

Furthermore, in U.S. Pat. No. 5,953,779 Schwartz discloses a foam mattress assembly has a stack of foam mattress elements with one of their peripheral edges joined together such that the stack of foam mattress elements remains in a vertical stack. The containment system which keeps side-by-side mattresses together consists of a head and foot containment block extending across the top and bottom respectively of a pair of adjacent mattresses. The head and foot containment blocks make up a portion of the sleeping surface and are of a sufficient size and strength to prevent lateral outward movement of the pair of adjacent foam mattresses. Bedding for the mattress assembly is secured around the outer edge of the mattress or around the outer edge of the containment system by using a retainer rope tensioned around the mattress to hold the bedding into a groove.

Adjustable mattresses known in the art are of the type that allow the owner of the mattress to rearrange mattress layers are effective for providing a firmness adjustment for each of the two people using the mattress.

Side sleeping is one of the best sleeping positions for people suffering from chronic back pain, sleep apnea, or acid reflux, as well as anyone who is pregnant. It helps with keeping the airways open, head and neck aligned, and esophagus slightly elevated. These factors create an atmosphere that prevents snoring, sleep apnea, and acid reflux while ensuring comfort. In fact, one of the first lines of treatment for snoring and mild cases of sleep apnea is to start sleeping on the side.

When sleeping on the side using a conventional mattress, alignment of the spine is difficult to achieve, and many patients complain of back and neck problems associated with side sleeping. The lack of spinal alignment is typically more pronounced when side sleeping than for sleeping on one's back, because for the spine to remain straight, the mattress would need to adjust to the different dimensions and mass of the body parts, namely shoulders, lower torso and hips. The hips can range from being narrower than to much wider than the shoulders in accordance with the body shape, while the mass present at the hips versus the lower torso and shoulders can also vary. Back sleeping is often compromised due to mattresses that are too soft and "hammock". This is like sleeping with a slouch, which has many ill health effects.

Despite having mattresses with different and variable firmness options, the existing art does not offer an efficient sleep system for side sleeper which helps the user to better off-load the spine and nervous system through adjusting the sleep posture and keeping the spine aligned.

There exists a need for a sleep system that can provide for "neutral posture," a uniform and constant sleeping surface height at substantially the same level as a conventional bed, and yet a combination of different firmnesses that can help keep a user's spine aligned.

SUMMARY

The present disclosure provides, inter alia, novel and innovative solutions for the above-mentioned problems.

Usually choosing a mattress that can provide the user with both convenience and good posture is a hard and complicated process. Unlike back sleeping which is often compromised as beds are too soft and hammock and may have many ill health effects, side sleeping is one of the best and most common sleeping positions for people. Nevertheless, depending on the weight, gender and body type of the person using the mattress different support might be required to providing a neutral posture or aligned spine posture of mid and shoulder area of the body of the user. Furthermore, an appropriate neck support may be needed to extend this aligned spine posture to the neck area of the user. Moreover, for most mattresses the process of choosing is limited to lying on the mattress in the store and users do not get the opportunity to purchase the mattress and adjust it post-purchase without needing to return or replace the mattress. This process is even more complicated when two people with generally different body shapes and types want to use the same mattress.

Applicant has found that there is a need for a customizable mattress with zonal variation, to provide adjustable support for core and hip of a user lying on his or her side hence providing a neutral posture or aligned spine posture of mid and shoulder area of the body of the user. For example, each of three zones, namely upper, middle and lower, can be customizable.

Applicant has also found that there is a need to allow two people on the same bed to have different comfort and support layers, in particular in compression shipped foam mattresses.

Applicant has also found that there is a need for a system that involves a pillow and a mattress and provides adjustable support for core and hip, and neck of a user lying on his or her side hence providing a neutral posture or aligned spine posture of mid, shoulder and neck area of the body of the user. This can provide a neutral posture or aligned spine to improve both side and back sleeping with neural posture resulting in better sleep, less snoring and less pain.

In one aspect, the present disclosure provides a mattress comprising a stack of at least three mattress elements comprising at least one zonal mattress element having an upper section, a lower section and a midsection that is firmer than the upper and lower sections and configured to provide support for a hip area of a body of a user side sleeping on said mattress; the at least one zonal mattress element configured to provide support to maintain an aligned spine posture of mid and shoulder areas of said user, at least one uniform mattress element having a uniform firmness, wherein a zonal variation of the at least one zonal mattress element is adjusted by rearranging the stack of at least three mattress elements as to provide different users with different zonal variations.

It will be appreciated to those skilled in the art that a zonal mattress element refers to a mattress that has a higher stiffness in a particular zone, for example in the midsection, to provide better support for a specific area of the body, for example, the hip area of the person using the mattress. The upper and lower sections can be symmetric in terms of size and stiffness so that the user can rotate the mattress and use either upper or lower sections instead of each other. In some embodiments, the upper and lower sections can be asymmetric depending on the desired design and use. Headache and neck pain with shoulder symptoms is a condition that affects about 60% of the population. It is the fourth global disability. Less pressure on the true shoulder joint (glenohumeral) and the acromioclavicular joint is important and is especially helpful in reducing arthritis sufferers' pain. The shoulder affects the neck significantly. The neck cannot be in neutral posture without proper shoulder support.

In some embodiments, one or more of zonal elements may be used in combination with one or more uniform mattress elements to provide the user with a variety of zonal variation and general firmnesses.

In some embodiments, the mattress may comprise two or more of the stack of at least three mattress elements set side by side providing multiple users with individually adjustable zonal variation. Essentially, each user can adjust one of the stacks of at least three mattress elements independently of other persons.

In some embodiments, the mattress may further have a topper element which is made of two or more elements or layers. This topper can be flipped to provide a firmer or softer top feel depending on the firmness of the elements used in the topper.

It will be appreciated by those skilled in the art that the topper may be used with other layers to provide different levels of firmness, for example, it can be put on the bottom of the mattress stack to provide a firmer mattress with higher zonal variation.

In one embodiment, the topper may span over the entire width of the conventional mattress or bed from twin to full or double, queen and king size providing, among other things, continuity feeling for the users. The users will not feel mattress elements as separate in the middle with this design of topper, thus improving comfort.

In another broad aspect, the present disclosure provides a sleep system comprising a mattress as described above in combination with a multi-fit pillow wherein said mattress and pillow are configured to provide support to maintain an aligned spine posture of the user. In some embodiments, the sleep system offers the end user or consumer with more than 112 possible options (in some cases 128 to 160 options) with only one stock keeping unit (SKU) of a mattress and one SKU of a pillow provides personalized comfort, support, less pain and much improved deep sleep.

In some embodiments, the system may further comprise a solid platform support to maximize the support of the mattress. This may provide much better support for the mattress than using slats.

BRIEF DESCRIPTION OF THE DRAWINGS

The present examples will be better understood with reference to the appended illustrations which are as follows.

DESCRIPTION

Figure 1A:
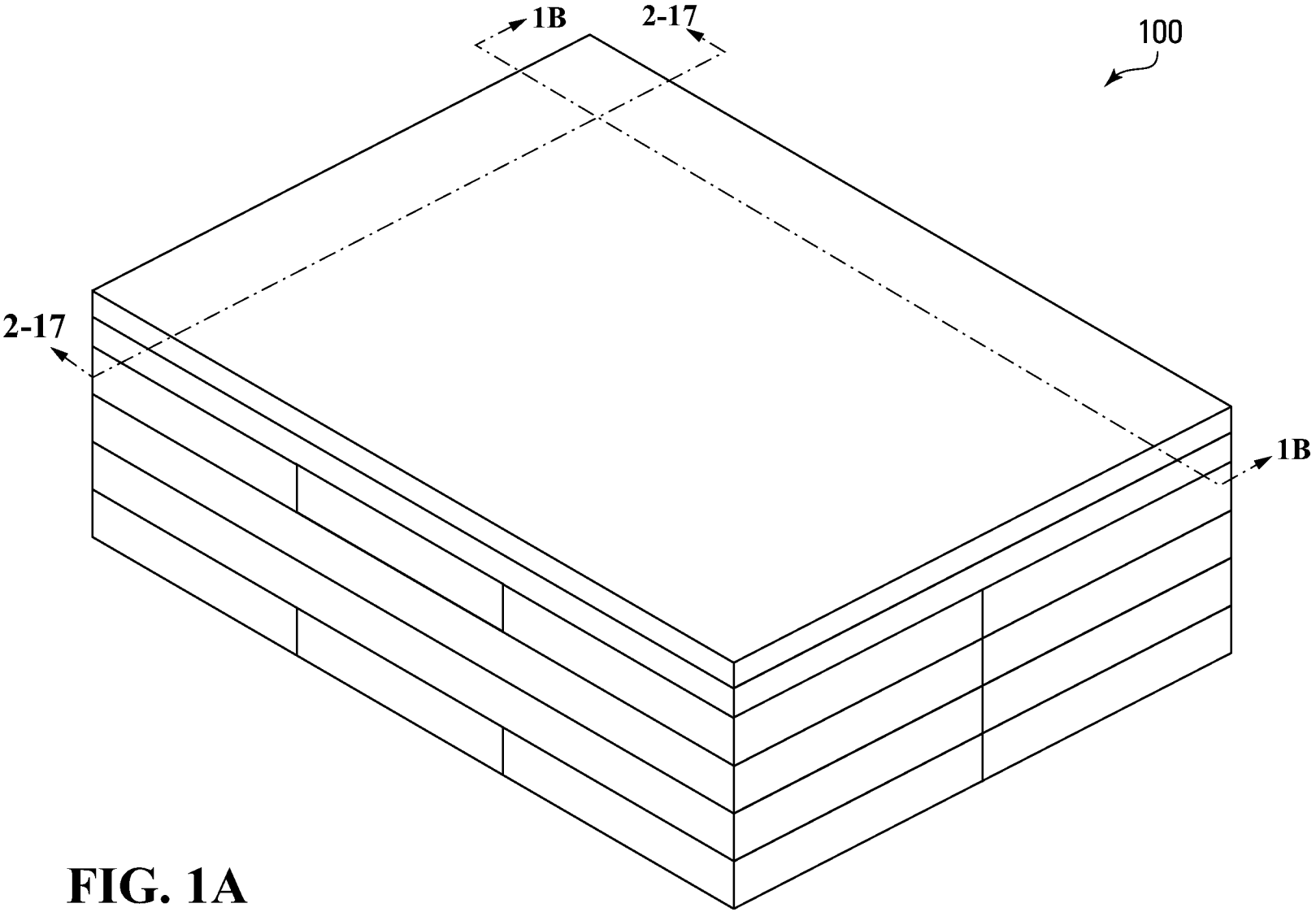
FIG. 1A is a perspective view of a mattress in accordance with one embodiment of the present disclosure having two zonal mattress elements and a two element topper that is detachable.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the scope of the invention. Thus, it is intended that the present invention cover the modifications and variations of this invention provided they come within the scope of the appended claims and their equivalents. Reference will now be made in detail to the preferred embodiments of the invention.

Usually choosing a mattress that can provide the user with both convenience and good posture is a hard and complicated process. Side sleeping is one of the best sleeping positions for people but depending on the weight, gender and body type of the person using the mattress different support might be required to providing a neutral posture or aligned spine posture of mid and shoulder area of the body of the user. Furthermore, an appropriate neck support may be needed to extended thus aligned spine posture to the neck area of the user. Moreover, for most mattresses the process of choosing is limited to lying on the mattress in the store and users do not get the opportunity to purchase the mattress and adjust it post-purchase without needing to return or replace the mattress. This process is even more complicated when two people with generally different body shapes and types want to use the same mattress.

Applicant has found that there is a need for a customizable mattress with zonal variation, to provide adjustable support for core, user will not feel mattress pieces separate in the middle with this design of topper. Therefore, more comfort hip and shoulder of a user lying on his or her side hence providing a neutral posture or aligned spine posture of mid and shoulder area of the body of the user.

Applicant has also found that there is a need for a system that involves a pillow and a mattress and provides adjustable support for core and hip, and neck of a user lying on his or her side hence providing a neutral posture or aligned spine posture of mid, shoulder and neck area of the body of the user.

In one aspect, the present disclosure provides a mattress comprising a stack of at least three mattress elements comprising at least one zonal mattress element having an upper section, a lower section and a midsection that is firmer than the upper and lower sections and configured to provide support for a hip area of a body of a user side sleeping on said mattress; at least one zonal mattress element configured to provide support to maintain an aligned spine posture of mid and shoulder areas of said user, at least one uniform mattress element having a uniform firmness, wherein a zonal variation of the at least one zonal mattress element is adjusted by rearranging the stack of at least three mattress elements as to provide different users with different zonal variations.

It will be appreciated to those skilled in the art that a zonal mattress element refers to a mattress that has a higher stiffness in a particular zone, for example in the midsection, to provide better support for a specific area of the body, for example, the hip area of the person using the mattress. Customizable zonal mattress elements bring a unique health benefit to chronic conditions like fibromyalgia, arthritis, etc. The upper and lower sections can be symmetric in terms of size and stiffness so that the user can rotate the mattress and use either upper or lower sections instead of each other. In some embodiments, the upper and lower sections can be asymmetric depending on the desired design and use.

In some embodiments, one or more of zonal elements may be used in combination with one or more uniform mattress elements to provide the user with a variety of zonal variation and general firmnesses.

In some embodiments, the mattress may comprise two or more of the stack of at least three mattress elements set side by side providing multiple users with individually adjustable zonal variation. In other words, each user can adjust one of the stacks of at least three mattress elements independently of the other person.

In some embodiments, the mattress may further have a topper element which is made of two or more elements. This topper can be flipped so that to provide a firmer or softer top feel depending on the firmness of the elements user in the topper.

In some embodiments, the topper has two elements or layers that are glued together to create a cool dry and comfortable topper. This topper can be flipped or rotated well on the top for a firmer top feel or moved under the mattress and provide a firm or more rigid sleep.

It will be appreciated by those skilled in the art that the topper may be used with other layers to provide different levels of firmness, for example, it can be put on the bottom of the mattress stack to provide a firmer mattress with higher zonal variation.

In one embodiment, the topper may span over the entire width of the conventional mattress or bed from twin to full or double, queen and king size providing, inter alia, continuity feeling for the users.

In another broad aspect, the present disclosure provides a sleep system comprising a mattress as described above in combination with a multi-fit pillow wherein said mattress and pillow are configured to provide support to maintain an aligned spine posture of the user. Alignment of the spine involves ensuring that the firmness/softness properties of the mattress match the variable body shape and mass distribution between shoulders, mid-torso and hips so that a side-sleeper can maintain good spinal posture. The firmness/softness properties involve a variation between an upper shoulder region, middle hip region and a lower leg region that is also referred to herein as the zonal variation.

In some embodiments, the system may further comprise a solid platform support to maximize the support of the mattress. This may provide much better support for the mattress than using slats.

Figure 1B:
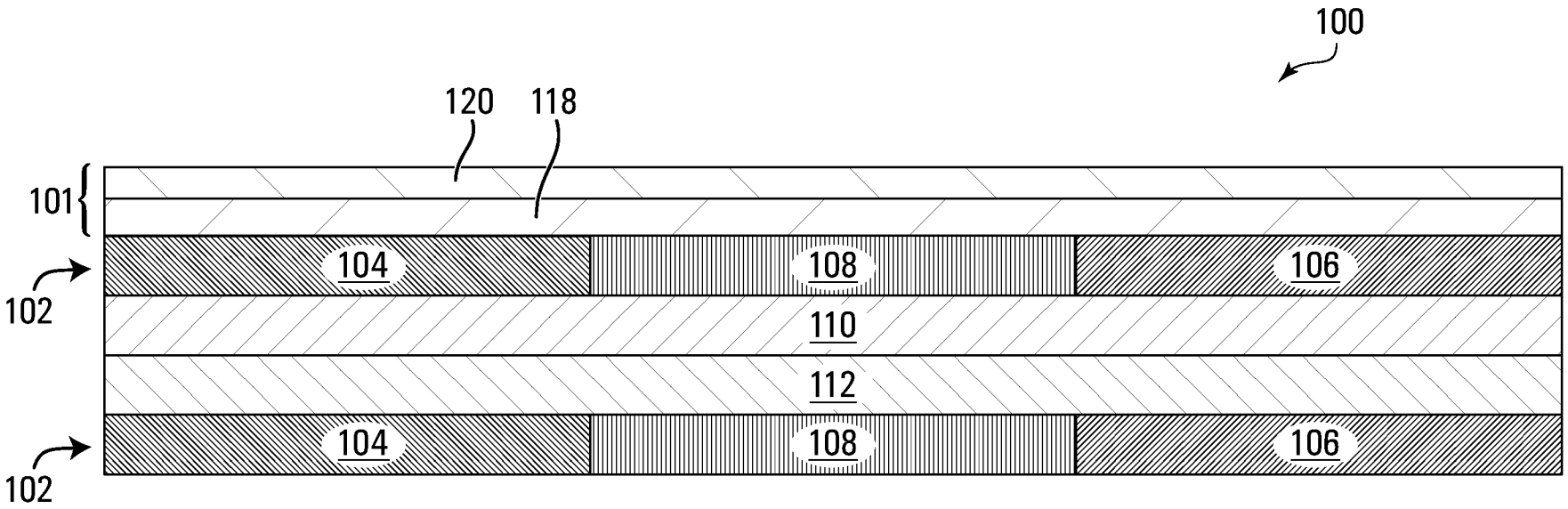
FIG. 1B is a schematic lengthwise cross-section view of a mattress in accordance with one embodiment of the present disclosure having two zonal mattress elements and a two element topper.

Referring to FIGS. 1A and 1B, a schematic lengthwise cross-section view of a mattress 100 in accordance with one embodiment of the present disclosure is illustrated. As illustrated, the mattress 100 has two zonal mattress element 102 each of which is comprised of a upper section 106, a lower section 104 and a midsection 108 that is firmer than said upper and lower sections 106 and 104 and configured to provide support for a hip area of a body of a user side sleeping on the mattress 100.

In one preferred embodiment, the topper is 3" element which is comprised of a 1" and a 2" elements. The stack of mattress elements has four elements each of which has a 2" thickness which brings the thickness of the whole mattress and topper to 11".

The mattress 100 is further comprised of two uniform mattress elements 110 and 112 which are respectively firmer and softer, and may have different stiffnesses as to provide the user with a wider variety of options to arrange them and getting more zonal variation options.

As shown in FIG. 1B, in some embodiments having a topper element 101 made of two or more elements 118 and 120 respectively softer and stiffer providing different stiffness for the user.

In some embodiments, in order to provide and maintain the "neutral posture" of the user, the present disclosure may use a mid or central High Resiliency (HR) foam that provides the density, hardness and support that the midsection of the average human body which is the heaviest section requires. A main feature of this disclosure is a zonal mattress element 102 which provides the adipose or fat tissue on the hip or buttocks the opportunity to rest into the a mid mattress element section such as an HR foam with a bulk density of approximately 45 (kg/m3) and a compression hardness approximately 1.5 (kpa) and a denser yet cushioning layer with a bulk density of approximately 45 (kg/m3) and a compression hardness approximately 2.5 (kpa). This minimizes pressure points on the skin and soft tissues, while the skeleton is supported by the much denser foam below. The user will feel pressure "up" and will not feel that they "dip" or "drop" into the mattress. Furthermore, having an HR foam with a bulk density of approximately 50 (kg/m3) and a compression hardness approximately 1.6 (kpa) on each end, upper and lower of the zonal mattress element will give the comfort that the lower legs and shoulders/neck require. This lessens pressure points and assists in helping the user get into a deep sleep.

In some embodiments, a firmer full length or uniform mattress element 110 is placed above a moderate density uniform element 112 prevents the weight of the human body from sinking into the mattress to maintain a neutral posture. These two layers are the strength of the mattress for support and longevity. The combination of various densities strategically located based on body part, weight, the presence of skeletal joints, amount of sensory nerve tissue and circulatory vessels can reduce the strain on these tissues thus preventing or minimizing awareness of an uncomfortable feeling. This feeling is often reported as pressure on the skin or torque on the joints or lower back or neck. Shoulders and lower legs can still be heavy and require support which may be more applicable for full bed length support but they are highly innervated with sensory nerves that if sit directly on a hard surface would result in nerves firing more and making rest or deep sleep harder.

In one embodiment, the mattress 100 may have a one inch softer special cooling and dry foam (118) for the top to give the perfect comfort top layer that eases pressure points and immediately under it provides greater densities of foam in a strategic manner to hold up the body with less of a "hard" feeling directly on the skin or muscles. This may be better for those users with sensitive or prone to bruising of the skin with direct contact; they will do well with the system disclosed herein.

Figure 2:
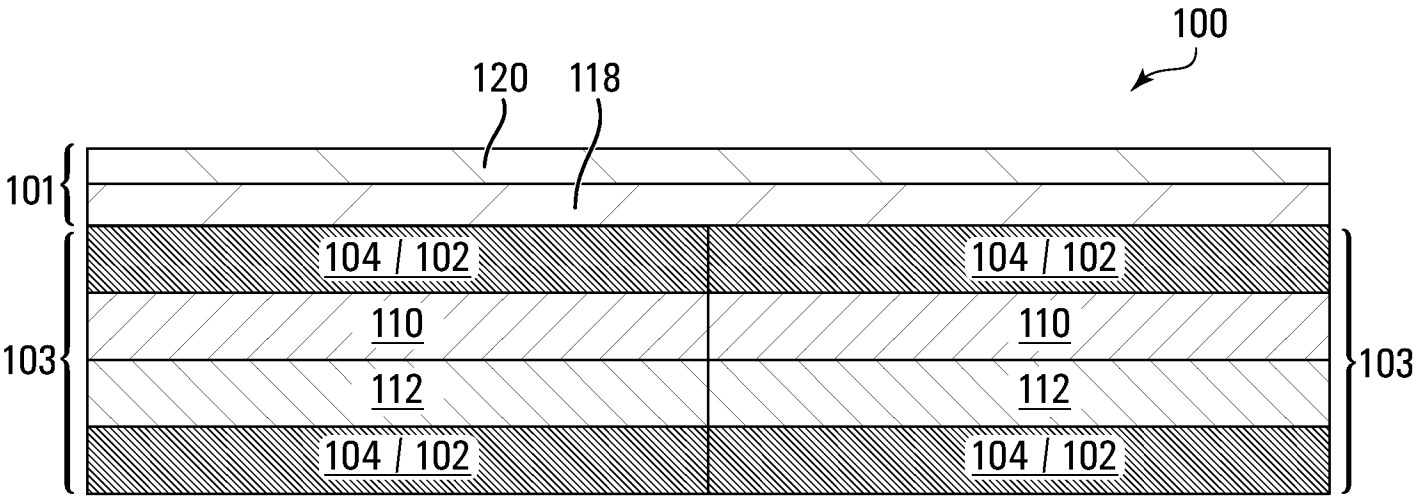
FIG. 2 is a schematic widthwise cross-section view of a mattress in accordance with one embodiment of the present disclosure having two symmetric stacks of mattress elements to provide a higher zonal variation and covered with a two-element topper.

Referring to FIG. 2, two symmetric stacks of mattress elements 103 are placed side by side to provide two users with independence by similar zonal variation. To provide a higher stiffness for the mattress 100, the element 120 is on the top. In one embodiment. Each of the two stacks of mattress elements 103 has two zonal elements 102 at the top and bottom and two uniform mattress elements 110 and 112 which are respectively firmer and softer on top of each other between the two zonal elements 102. This combination results in a higher zonal variation to the variation wherein the softer uniform mattress 112 is on top of stiffer uniform element 110, as illustrated in FIG. 3, as it allows the zonal variation of the element 102 to be more pronounced.

The configuration of 110 on top of 112 can provide the best level of zonal variation for up to 60% of the population adult people and provide the required support with comfort in addition to cool/dry technology in the foam in the topper.

As described herein, gender and body type may affect the type of the configuration that provides the desired support. Hence, more men will like and need this feeling of support, especially, men weighing over 175 lbs or for those that like a firm feel.

Figure 3:
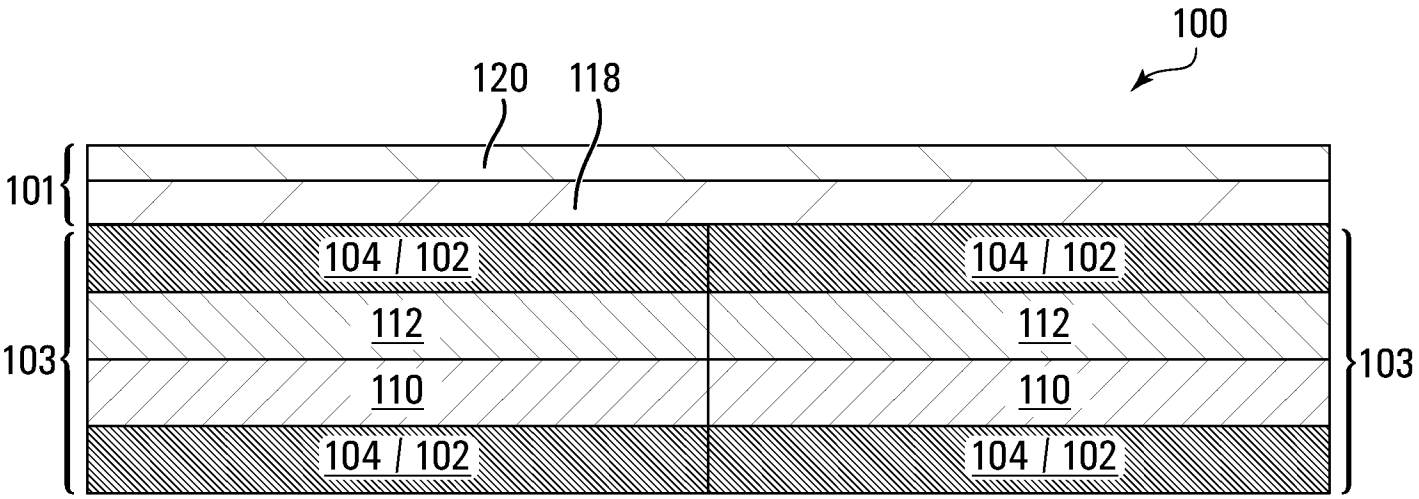
FIG. 3 is a schematic widthwise cross-section view of a mattress in accordance with one embodiment of the present disclosure having two symmetric stacks of mattress elements to provide less zonal variation and covered with a two-element topper.

In contrast, the combination shown in FIG. 3 having the element 112 on top of 110, provides a moderate firm sleep with dry and cooler topper. This may be anticipated to be for 30% if the population of adult people, mostly women and seniors, less than 175 lbs.

Figure 4:
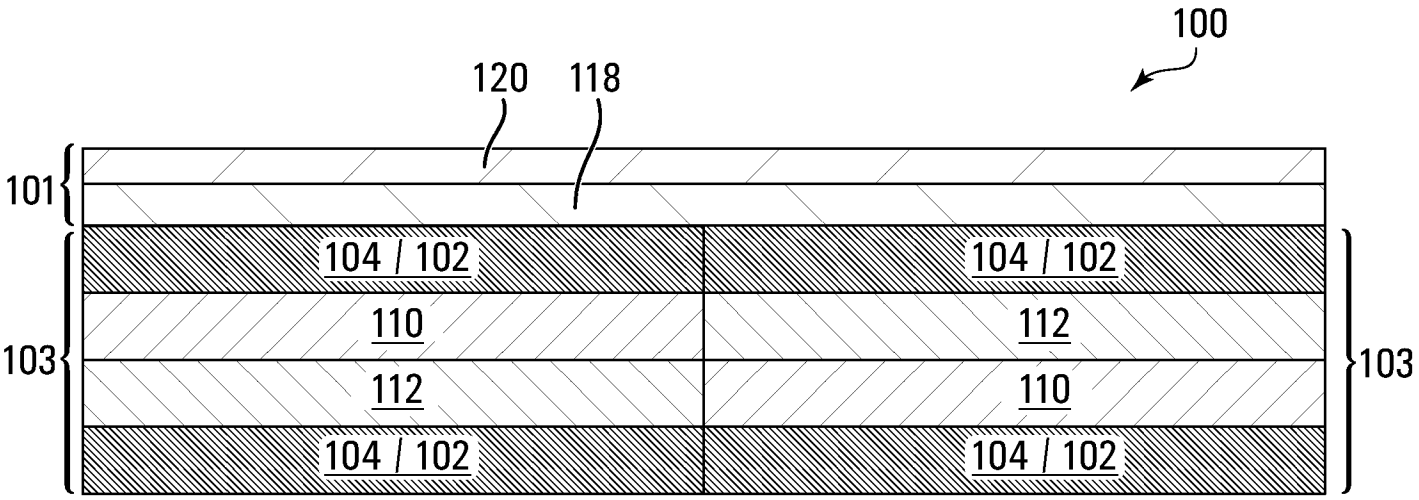
FIG. 4 is a schematic widthwise cross-section view of a mattress in accordance with one embodiment of the present disclosure having two asymmetric stacks of mattress elements with different zonal variations and covered with covered with a two-element topper.
Figure 5:
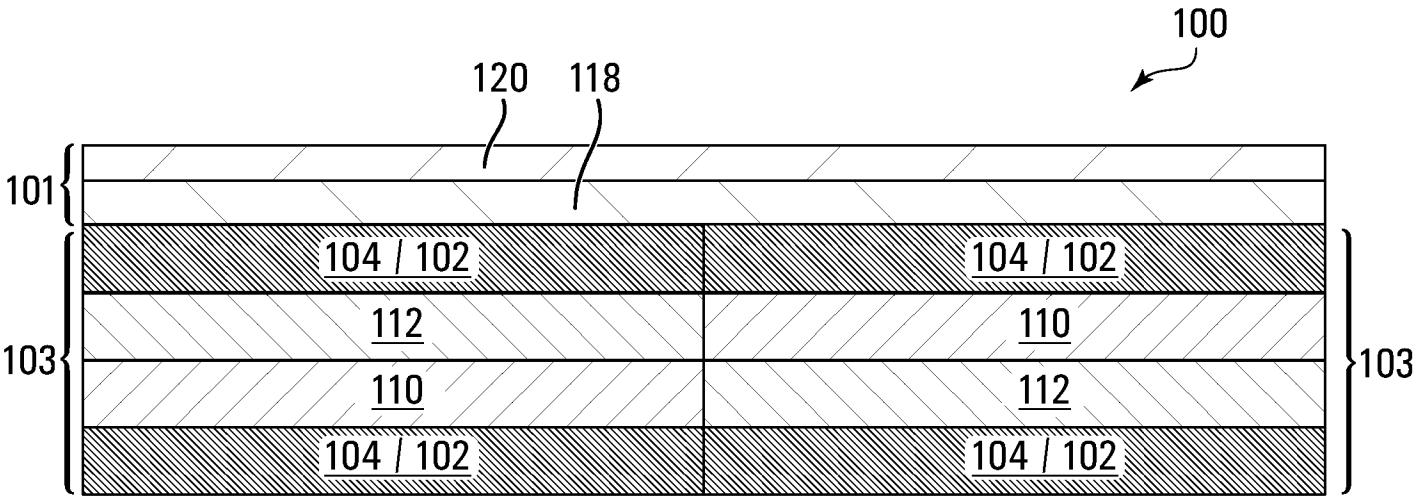
FIG. 5 is a mirror image of the schematic widthwise cross-section view of the mattress shown in FIG. 5.

Referring to FIG. 4, two asymmetric stacks of mattress elements 103 are placed side by side to provide two user with independent and different zonal variations. One of the stacks of mattress elements 103 has two zonal elements 102 at the top and bottom and two uniform mattress elements 110 and 112 which are respectively firmer and softer on top of each other between the two zonal elements 102. This combination results in a higher zonal variation to the variation wherein the softer uniform mattress 112 is on top of stiffer uniform element 110, as illustrated in FIG. 3, as it allows the zonal variation of the element 102 to be more pronounced.

Furthermore, the mattress 100, as illustrated in FIGS. 2, 3, 4 and 5 is covered with a topper 101 with two elements 120 and 118 providing continuity for the surface of the mattress. To provide a higher stiffness for the mattress 100, the element 120 is on the top.

Furthermore, the configuration shown in FIG. 4 allows a split between a medium/firm and firm for male and female or small and large partners sharing the same mattress. These are simply a mix of FIGS. 2 and 3 and would be very common when two people share a bed. The remaining arrangements may be a mix for the remaining 10% of the population of adult people.

Figure 6:
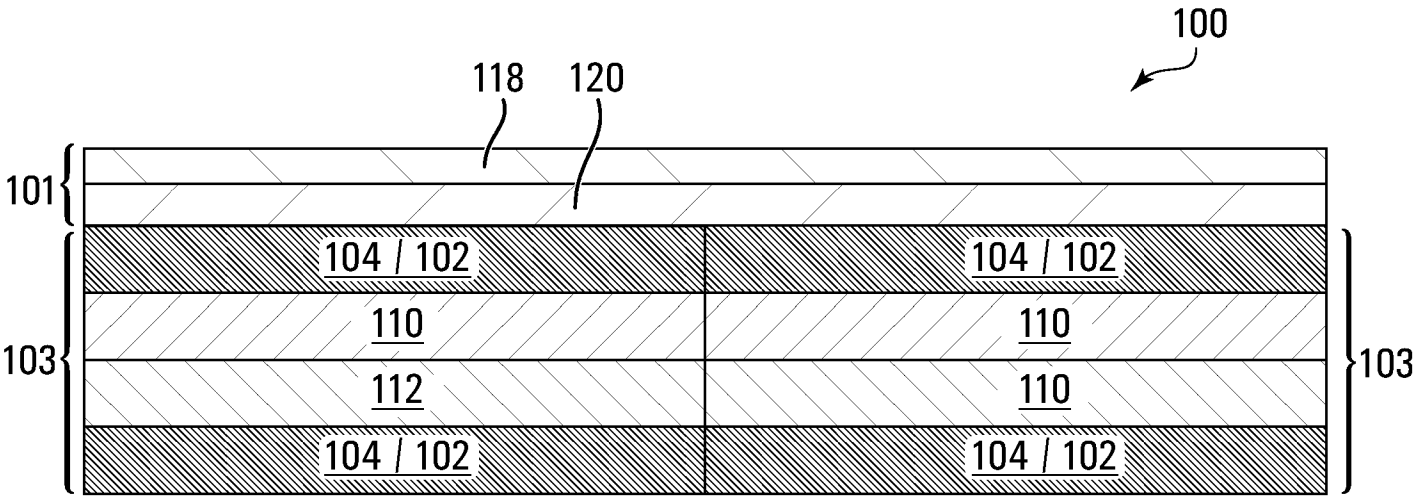
FIG. 6 is a schematic widthwise cross-section view of a mattress in accordance with one embodiment of the present disclosure having two symmetric stacks of mattress elements with same zonal variations and covered with a two-element topper.

Referring to FIG. 6, two symmetric stacks of mattress elements 103 are placed side by side to provide two users with independence by similar zonal variation similar to mattress shown in FIG. 2, but the topper 102 has the element 118 on the top providing a softer or less firm top layer.

Figure 7:
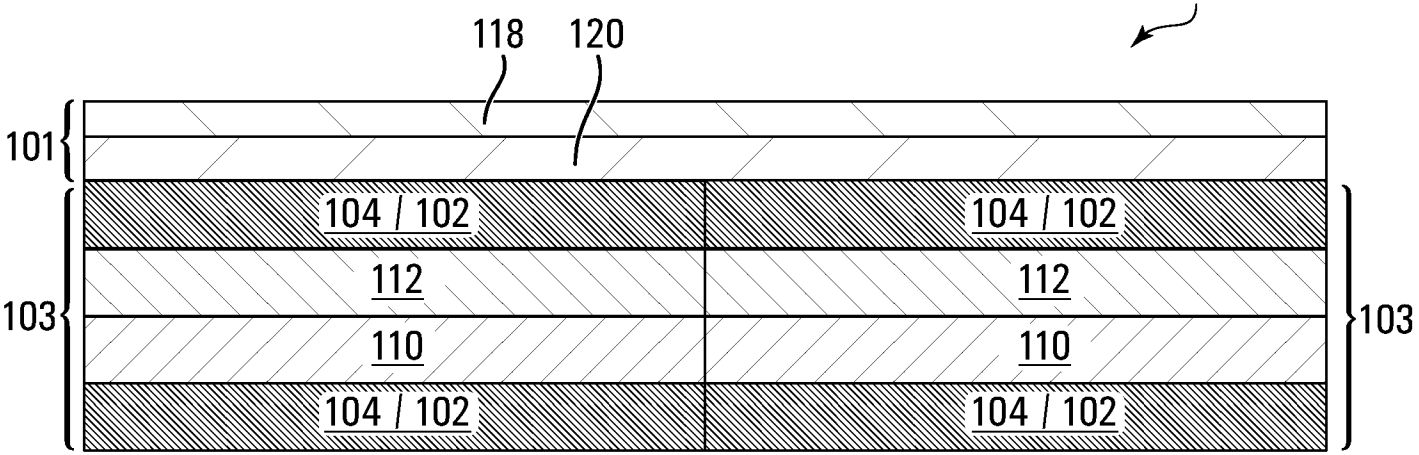
FIG. 7 is a schematic widthwise cross-section view of a mattress in accordance with one embodiment of the present disclosure having two asymmetric stacks of mattress elements with different zonal variations and covered with a two-element topper.
Figure 8:
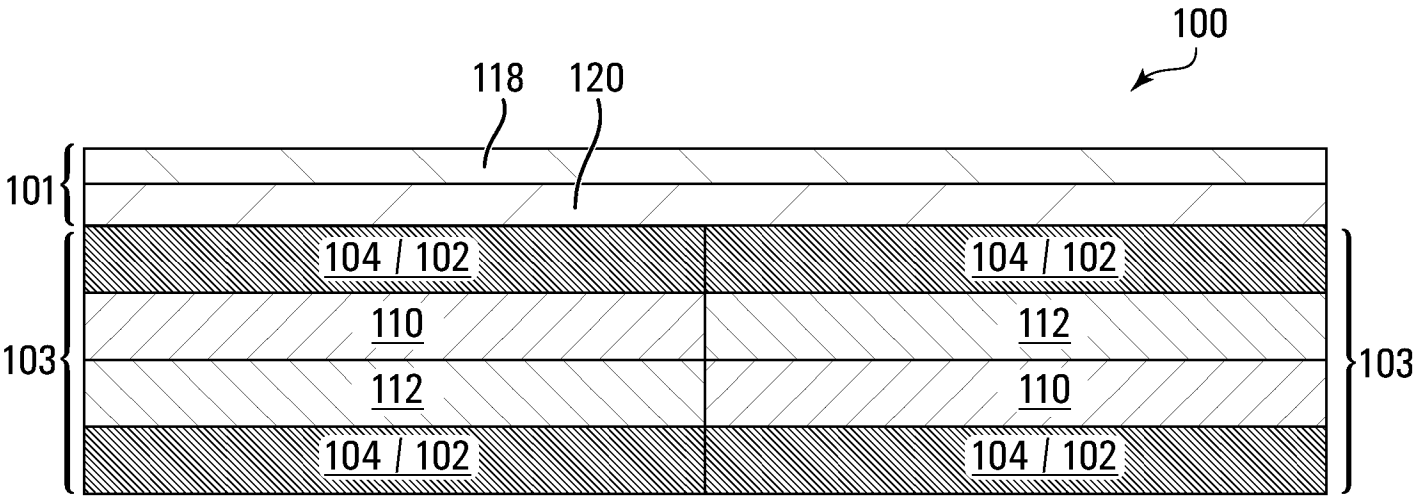
FIG. 8 is a schematic widthwise cross-section view of a mattress in accordance with one embodiment of the present disclosure having two asymmetric stacks of mattress elements with different zonal variations and covered with a two-element topper.
Figure 9:
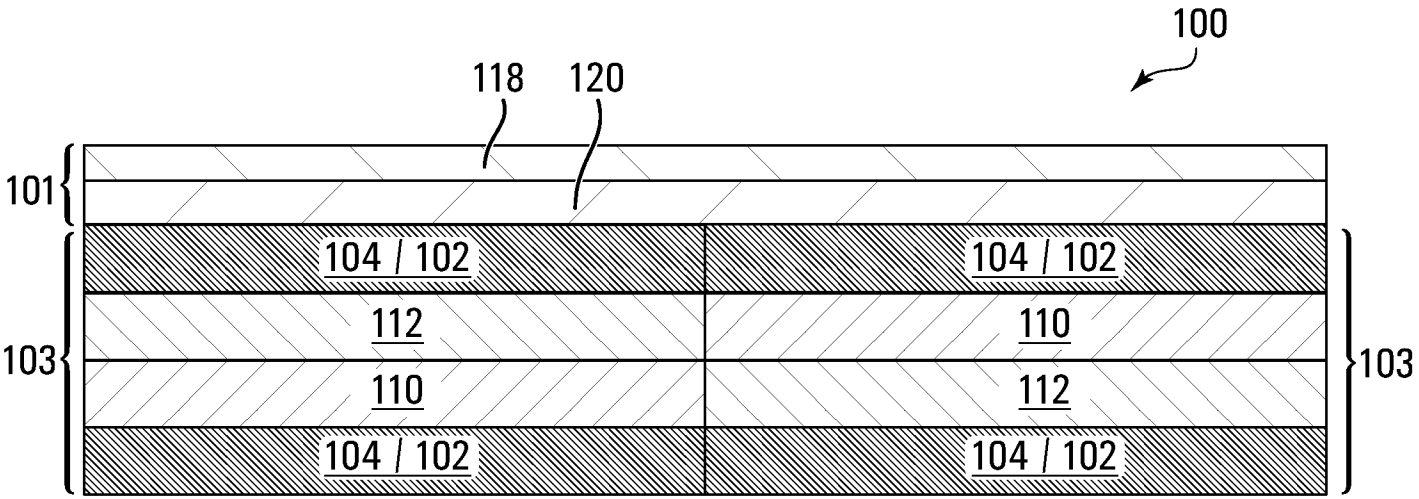
FIG. 9 is a mirror image of the schematic widthwise cross-section view of the mattress shown in FIG. 7.

As illustrated FIG. 7 is another embodiment of the mattress 100 wherein the two stacks of mattress element 103 are symmetrical and the topper 101 has the element 118 on the top. FIGS. 8 and 9 show two mirroring embodiments wherein the two stacks of mattress elements 103 are asymmetrical and the topper has the element 118 on the top.

Figure 10:
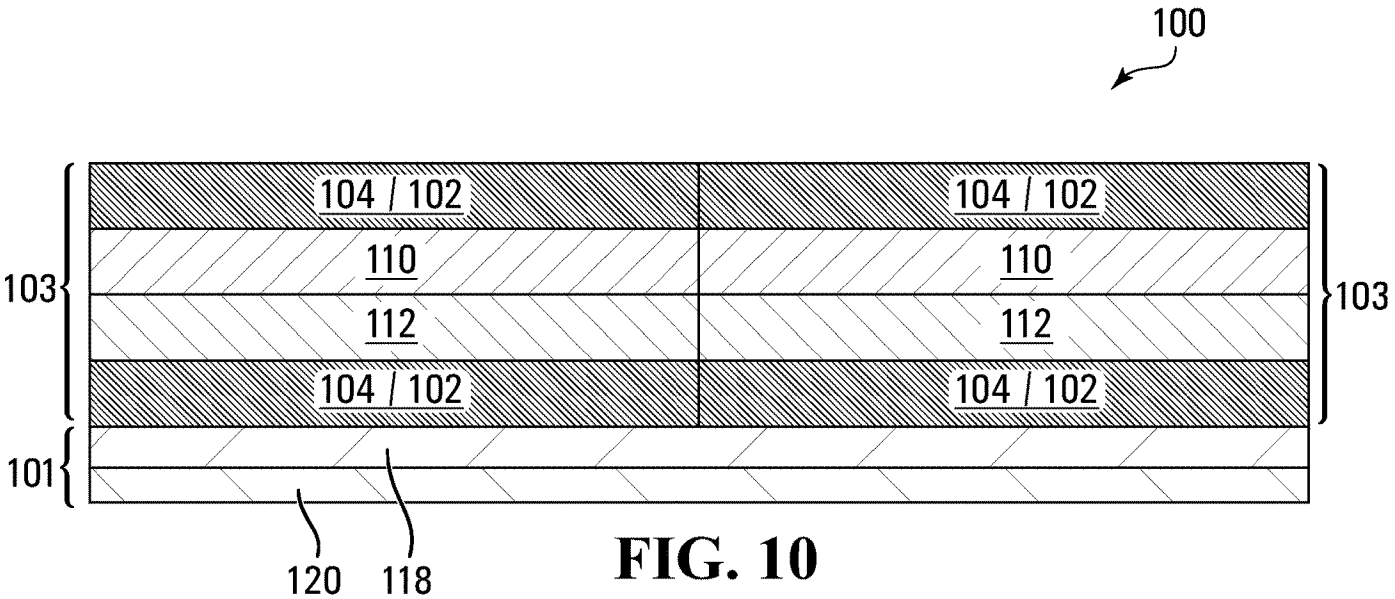
FIG. 10 is a schematic widthwise cross-section view of a mattress in accordance with one embodiment of the present disclosure having two symmetric stacks of mattress elements with different zonal variations and a two-element topper under the stack.
Figure 11:
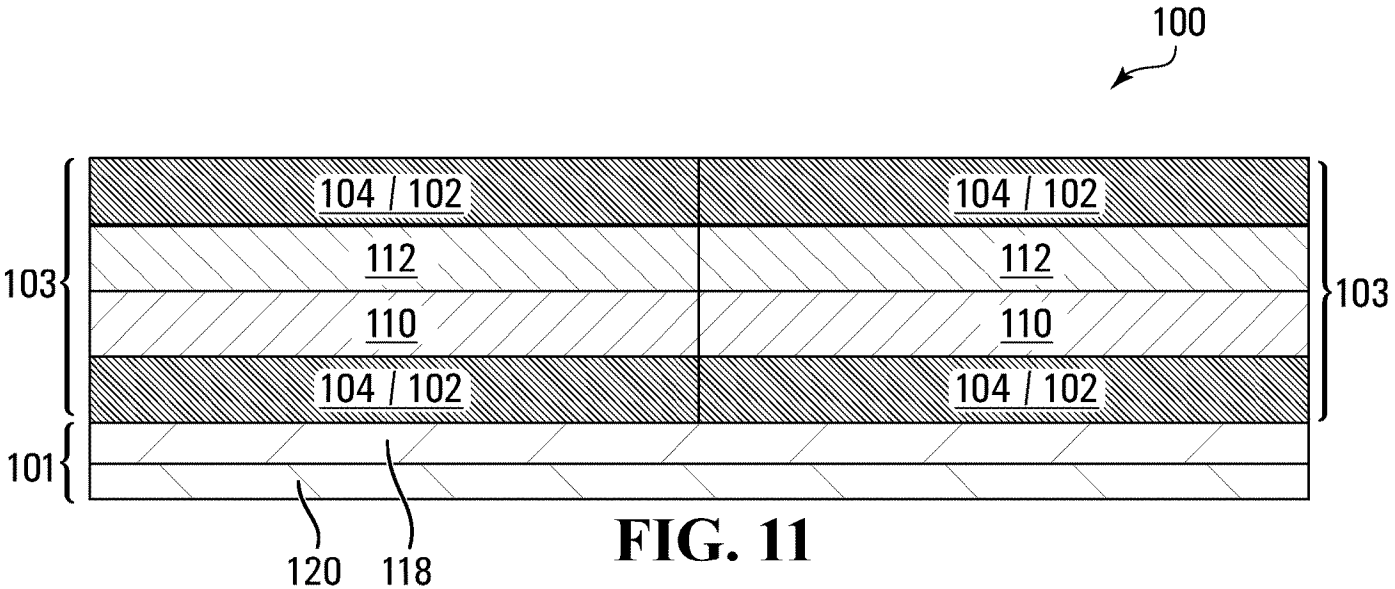
FIG. 11 is a schematic widthwise cross-section view of a mattress in accordance with one embodiment of the present disclosure having two symmetric stacks of mattress elements with different zonal variations and a two-element topper under the stack.
Figure 12:
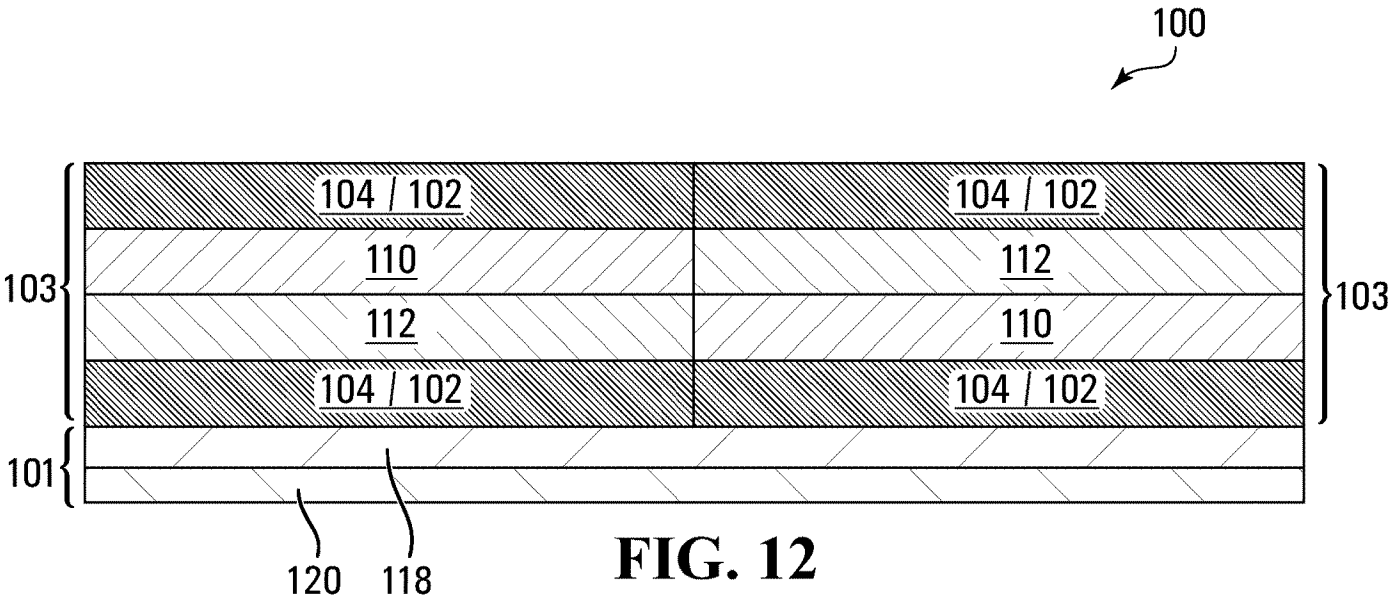
FIG. 12 is a schematic widthwise cross-section view of a mattress in accordance with one embodiment of the present disclosure having two asymmetric stacks of mattress elements with different zonal variations and a two-element topper under the stack.
Figure 13:
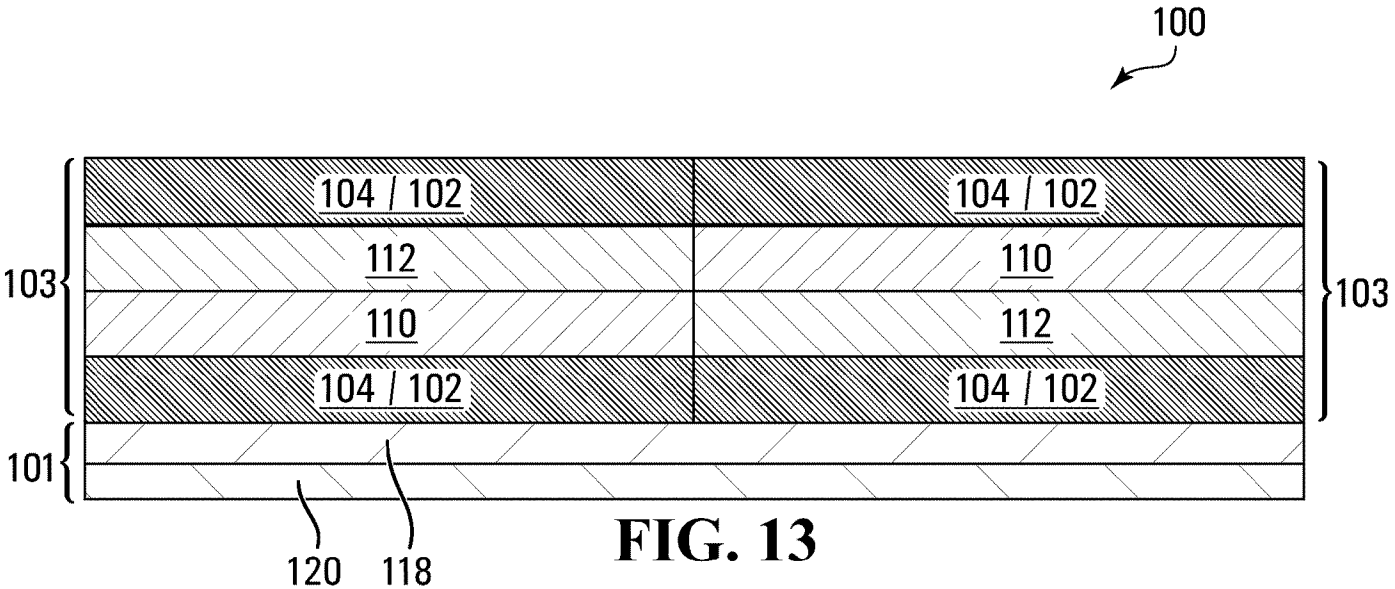
FIG. 13 is a mirror image of the schematic widthwise cross-section view of the mattress shown in FIG. 12.
Figure 14:
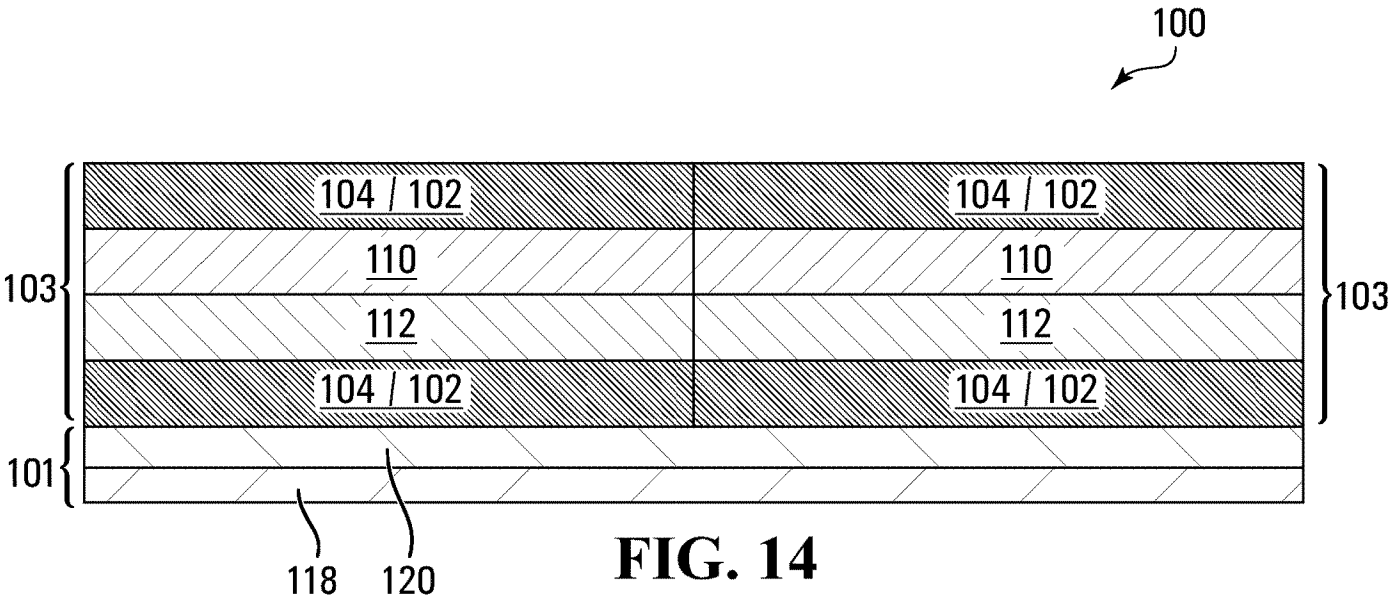
FIG. 14 is a schematic widthwise cross-section view of a mattress in accordance with one embodiment of the present disclosure having two symmetric stacks of mattress elements with different zonal variations and a two-element topper under the stack.
Figure 15:
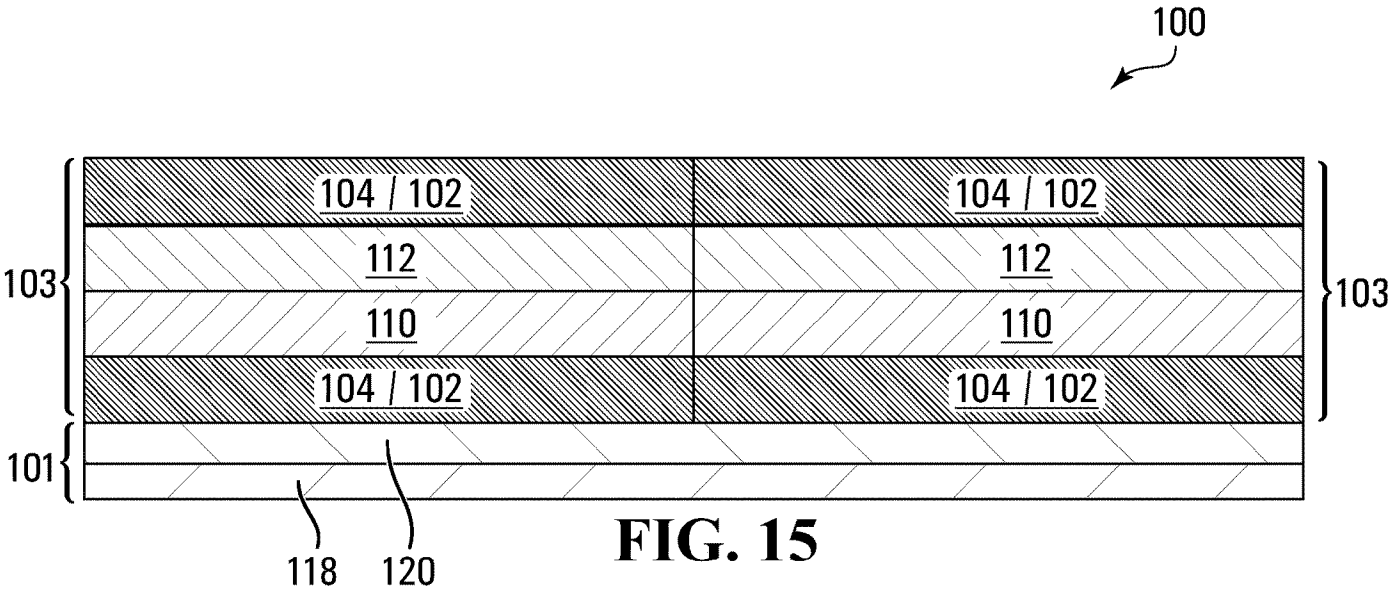
FIG. 15 is a schematic widthwise cross-section view of a mattress in accordance with one embodiment of the present disclosure having two symmetric stacks of mattress elements with different zonal variations and a two-element topper under the stack.
Figure 16:
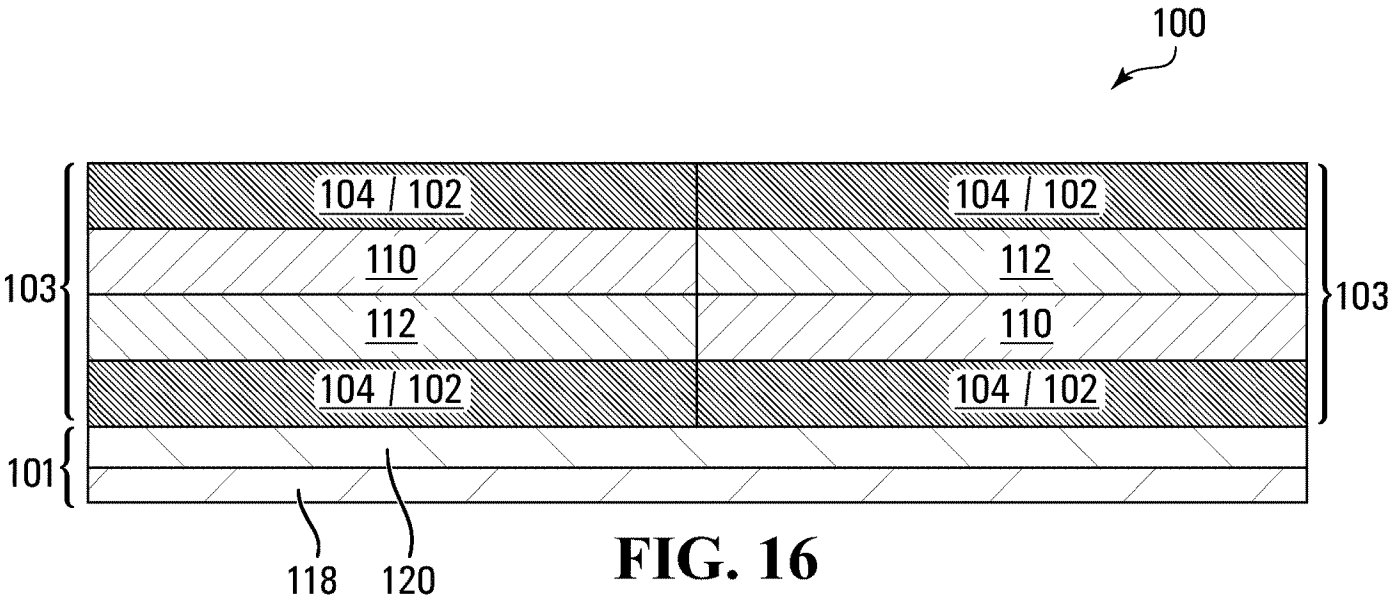
FIG. 16 is a schematic widthwise cross-section view of a mattress in accordance with one embodiment of the present disclosure having two asymmetric stacks of mattress elements with different zonal variations and a two-element topper under the stack.
Figure 17:
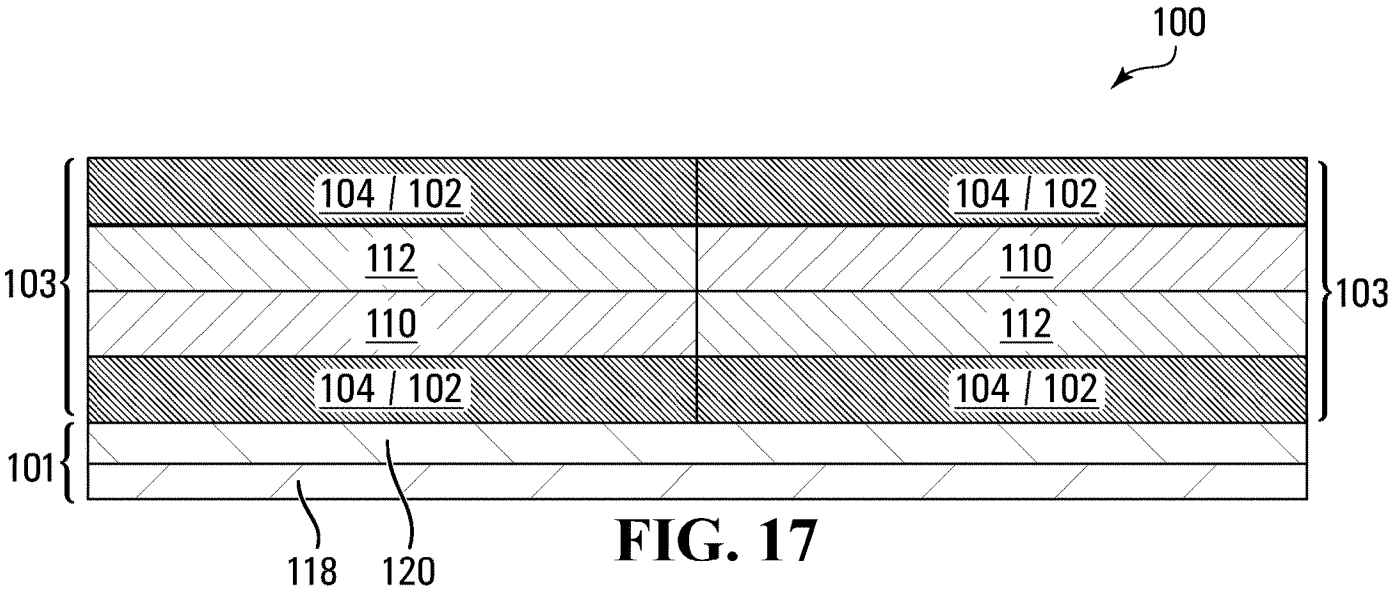
FIG. 17 is a mirror image of the schematic widthwise cross-section view of the mattress shown in FIG. 16.

Referring to FIG. 10, the mattress 100 is illustrated having the topper 101 placed under two stacks of mattress elements 103. In this embodiment, the topper 101 works in combination with elements 102, 110 and 112 to provide more zonal variation options for the users. FIGS. 11 to 17 show different embodiments of the present invention with different combinations of elements 102, 112 and 110 of the stack of mattress elements 103 in combination with the elements 118 and 120 of the topper 101 placed under the stack.

As illustrated in the configuration shown in FIGS. 10-17 a relative firmer mattress is provided by moving the topper to the bottom position. The firmest set up among embodiments shown herein is the configuration shown in FIG. 15, designed for those with less sensitive skin and not prone to pressure points.

In some embodiments, the sleep system disclosed herein comprises a mattress and a pillow that together offer the end user or consumer with over 112 possible options with only one stock keeping unit (SKU) of a mattress and one SKU of a pillow provides personalized comfort, support, less pain and much improved deep sleep.

In some embodiments, the sleep system is made up of a mattress that has six layers, four layers in the stock 103 and two layers of topper 101. The topper elements may be glued together to create a cool dry and comfortable topper that can be flipped or rotated well on the top for a firmer top feel or moved under the mattress and provide a firm or more rigid sleep. When the topper layers are not glued together, the number of possible adjustment options can be increased. The topper may span the entire width of the conventional mattress or bed from twin to full or double, queen and king size.

In some embodiments, layered core, base or as referred to herein stack 103 offers true personalization or customization for sleep. In one embodiment, the top and bottom zonal elements of the base may be divided into three equal parts, the upper 106, lower 104 and midsection 108 configured to offer the densest or harder HR foam in the centre to bolster the midsection of the human body, the area of the body that is generally 100% to 300% times heavier than above the mid-chest and below the knee joint line.

It will be appreciated by those skilled in the art that the system may have a topper with less or more elements or layers and it is possible to have mattress only with the stack elements 103 without the topper 101.

In some embodiments, the system provides a mattress 100 that has a base cut in half to form two stacks of mattress elements 103 or two separate stacks are put together to allow two users to choose their preferred comfort: medium firm or firm.

In some embodiments, a cover or the topper contains all components firmly and prevents the user from feeling any movement between the pieces.

It will be appreciated by those skilled in the art that depending on the dimensions of the mattress, such as single, twin, queen or king, the dimensions of the mattress elements as well as the dimensions of the upper section, the lower section and the midsection of the mattress may be adjusted to provide appropriate support for the hip area of the user and result in the spin's neutral posture.

In some embodiments, at the border of the stacks 103 one or more of the elements of the mattress stack 103 may have a wedge-shaped cross-section, and are attached to the corresponding bevelled edge of the corresponding mattress element.

Figure 18:
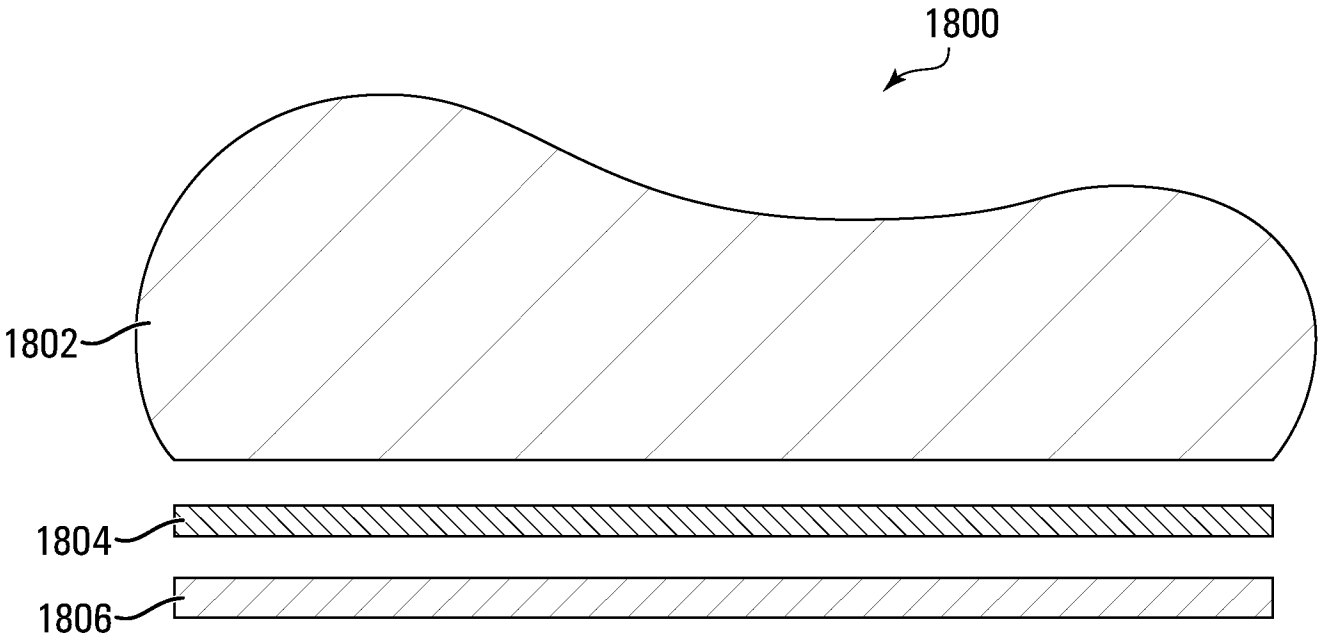
FIG. 18 is a schematic cross-section view of a pillow in accordance with one embodiment of the present disclosure.

In some embodiments, as shown in FIG. 18, a pillow 1800 consists of three pieces. The primary piece is a dual curved pillow 1802 with a large enough trough in the middle (supported by anthropometric measurements of the average head in length) so that the head can lie flat between the two curves to allow it to rest flat and the neck to remain straight thus minimizing nerve irritation, muscle contraction, blood vessel or circulation restriction and maximizing comfort and promoting a good sleep. The pillow system also has two slabs or risers 1804 and 1806 which are respectively thinner and thicker of foam with cotton covers.

In some embodiments, the other two components of the pillow system are slabs of foam called risers. In one embodiment, the thin riser 1804 may have a ⅞" thickness and the thicker riser 1806 may have a thickness of 1⅜". They both allow the user to increase the height of the pillow for more support when side sleeping and minimize the use of other pillows that are shaped incorrectly which would deflect the ability to achieve proper neck alignment with any pillow.

In some embodiments, the pillow may be helpful to open up the airways, minimizing snoring and helps to maintain a neutral posture of the entire spine, which includes the neck or cervical spine. The trough length or space/distance can be important for neutral neck posture.

In some preferred embodiments, the set up of the mattress 100 may be specific to maximize the support of the foam and maximize the support of the user, therefore, a solid wood platform bed may be used.

In one embodiment, a solid boxspring with 1 inch MDF board may be used covering the entire surface area of the box spring before this foam mattress is placed on top of it.

While in some embodiments, the mattress elements are superposed with foam to foam contact in a manner that allows the stack of mattress elements to behave like a single block of foam, it will be appreciated that in some embodiments, the mattress elements can be provided with a cover or a thin layer of material at their interfaces that will either allow them not to move relative to each other or alternatively, by changing the type of the cover or thin layer as known in the art, to move easily relative to each other at their interfaces.

The invention claimed is:

1. A mattress comprising:

a stack of four mattress elements comprising:

a first zonal mattress element having a softer upper section, a softer lower section and a firmer midsection that is firmer than said softer upper and softer lower sections, each section being about a third of a length of the first zonal mattress element and occupying the full width of the first zonal mattress element, the three sections configured to provide support to maintain an aligned spine posture for side sleeping by having the softer upper section support a shoulder area, the firmer midsection support a hip area, and the softer lower section support a leg area;

a firm uniform mattress element, said firm uniform mattress element having a first side in direct contact with a side of said first zonal mattress element;

a soft uniform mattress element, said soft uniform mattress element having a firmness softer than the firm uniform mattress element, said soft uniform mattress element having a first side in direct contact with a second side of said firm uniform mattress element;

and a second zonal mattress element identical to the first zonal mattress element, said second zonal mattress element having a side in direct contact with a second side of said soft uniform mattress element wherein the mattress provides a first zonal variation when the mattress is disposed with the firm uniform mattress element on top of the soft uniform mattress element, and a second zonal variation when the mattress is disposed with the soft uniform mattress element on top of the firm uniform mattress element, and the difference in zonal variation is due to the relative positioning of the firm uniform mattress element and the soft uniform mattress element;

and wherein with the first zonal variation the mattress provides a desired spinal alignment support for side sleeping required by most individuals weighing over 175 lbs, and with the second zonal variation the mattress provides a desired spinal alignment support for side sleeping required by most individuals weighing less than 175lbs.

2. The mattress as defined in claim 1 having a topper element made of two or more elements each providing different firmness levels.

3. The mattress as defined in claim 1 comprising two or more of said stack of four mattress elements wherein said zonal variation of each of said two or more stack of mattress elements are adjustable independently of each other.

4. The mattress as defined in claim 3 having a topper element wherein said topper element substantially covers said two or more stacks of four mattress elements to provide continuity for said mattress.

5. A sleep system comprising:

mattress as defined by claim 1;

a multi-fit pillow;

wherein said mattress and pillow are configured to provide support to maintain an aligned spine posture of a user.

6. The system as defined in claim 5, further comprising a solid platform support to maximize the support of the mattress.

7. The mattress as defined in claim 1, further comprising a layer of cooling foam.

8. The mattress as defined in claim 2, wherein said topper element is of about 3 inches thick, and comprises two elements, wherein one of the elements is a soft cooling foam and has a thickness of about one inch and the other element is a stiffer foam and has a thickness of about 2 inches thick for a total mattress thickness of about 11 inches from six elements: two elements from the topper element and four mattress elements.

9. The mattress as defined in claim 2, wherein said topper element is detachable from said stack and comprises a softer foam element and a stiffer foam element glued together.

10. The mattress as defined in claim 4, wherein said topper element is detachable from said stack and comprises a softer foam element and a stiffer foam element glued together.

11. The system of claim 5, further comprising a topper element made of two or more elements each providing different firmness levels.

12. The system of claim 5, wherein the multi-fit pillow increases sleep by opening the airway of the neck and maintaining neutral posture in the spine, and comprises:

a middle layer shaped to have a trough in which a head may rest during sleep;

two layers of foam of different levels of firmness;

whereby the system has a total of nine layers: four layers of mattress elements, two layers of elements from a topper element, and three layers from the multi-fit pillow.

13. A mattress comprising:

a stack of four mattress elements comprising:

a first zonal mattress element having a softer upper section, a softer lower section identical to the softer upper section and a firmer midsection that is firmer than said softer upper and softer lower sections, each section being about a third of a length of the first zonal mattress element and occupying the full width of the first zonal mattress element, the three sections configured to provide support to maintain an aligned spine posture for side sleeping by having the softer upper section support a shoulder area, the firmer midsection support a hip area, and the softer lower section support a leg area;

a firm uniform mattress element, said firm uniform mattress element having a first side in direct contact with a side of said first zonal mattress element;

a soft uniform mattress element, said soft uniform mattress element having a firmness softer than the firm uniform mattress element, said soft uniform mattress element having a first side in direct contact with a second side of said firm uniform mattress element;

a second zonal mattress element identical to the first zonal mattress element, said second zonal mattress element having a side in direct contact with a second side of said soft uniform mattress element;

wherein the mattress provides a first zonal variation when the mattress is disposed with the firm uniform mattress element on top of the soft uniform mattress element, a second zonal variation when the mattress is disposed with the soft uniform mattress element on top of the firm uniform mattress element, and the difference in zonal variation is due to the relative positioning of the firm uniform mattress element and the soft uniform mattress element; and wherein with the first zonal variation the mattress provides a desired spinal alignment support for side sleeping required by most individuals weighing over 175 lbs, and with the second zonal variation the mattress provides a desired spinal alignment support for side sleeping required by most individuals weighing less than 175lbs.

14. A mattress comprising:

a stack of four mattress elements comprising:

a first zonal mattress element having a softer upper section, a softer lower section and a firmer midsection that is firmer than said softer upper and softer lower sections, each section being about a third of a length of the first zonal mattress element and occupying the full width of the first zonal mattress element, the three sections configured to provide support to maintain an aligned spine posture for side sleeping by having the softer upper section support a shoulder area, the firmer midsection support a hip area, and the softer lower section support a leg area;

a firm uniform mattress element, said firm uniform mattress element having a first side in direct contact with a side of said first zonal mattress element;

a soft uniform mattress element, said soft uniform mattress element having a firmness softer than the firm uniform mattress element, said soft uniform mattress element having a first side in direct contact with a second side of said firm uniform mattress element;

a second zonal mattress element identical to the first zonal mattress element, said second zonal mattress element having a side in direct contact with a second side of said soft uniform mattress element;

wherein the mattress provides a first zonal variation when the mattress is disposed with the firm uniform mattress element on top of the soft uniform mattress element, a second zonal variation when the mattress is disposed with the soft uniform mattress element on top of the firm uniform mattress element, and the difference in zonal variation is due to the relative positioning of the firm uniform mattress element and the soft uniform mattress element; and wherein the first and second zonal variation in combination provide spinal alignment for a larger proportion of adult side sleepers than either the first or second zonal variation alone.

* * * * *